United States Patent [19]

Rackman

[11] 4,108,443

[45] Aug. 22, 1978

[54] BOARD GAME

[76] Inventor: Michael I. Rackman, 1710 Glenwood Rd., Brooklyn, N.Y. 11230

[21] Appl. No.: 774,245

[22] Filed: Mar. 4, 1977

[51] Int. Cl.[2] ..... A63F 3/00

[52] U.S. Cl. ..... 273/243; 273/273; 273/282; 273/291

[58] Field of Search ..... 273/243, 273

[56] References Cited

U.S. PATENT DOCUMENTS

| | | | |
|---|---|---|---|
| 3,126,205 | 3/1964 | Jordan | 273/273 |
| 3,378,261 | 4/1968 | Schriber | 273/273 |
| 3,876,206 | 4/1975 | Moura | 273/273 |
| 3,899,176 | 8/1975 | Gregan | 273/236 |

*Primary Examiner*—Richard C. Pinkham
*Assistant Examiner*—Harry G. Strappello
*Attorney, Agent, or Firm*—Gottlieb, Rackman & Reisman

[57] ABSTRACT

A board game in which two players have facing sets of numbered pieces, each piece of each player being capable of capturing a predetermined number of the other player's pieces in accordance with their numerical values. Each turn consists of a player capturing those pieces which he can, removing the captured and capturing pieces from play, and then making a "move." A move involves a player re-positioning one of his pieces which remain in play in his line of pieces. The type of move taken by a player is determined by the roll of a die.

36 Claims, 3 Drawing Figures

BOARD GAME

This invention relates to board games, and more particularly to a board game based partially on the skill of the players and partially on chance.

It is a general object of my invention to provide a board game which is inexpensive to manufacture, whose rules are simple to learn, whose playing time is relatively short (in the order of ten to twenty minutes), and which allows the players to make strategic moves thereby permitting winning play based on skill, but with an element of chance for increasing player interest.

In the illustrative embodiment of the invention, each player is provided with a set of ten pieces numbered 1 through 10. (In general, each set should have between 7 and 14 pieces, although 10 is best.) The two sets of pieces are lined up facing each other, and each piece is capable of capturing three of the other player's pieces. The players take alternate turns, each turn consists of two parts. The first is the "capture" step during which each piece of a player which faces a piece of the other player which it can capture is removed from the board together with the captured piece, the player thus scoring a point. The second part of each turn consists of a player removing one of his pieces which remain in play and re-positioning it in his line of pieces. The type of move which is taken depends on the roll of a die. Because the "capture" step of each turn precedes the "move" step, the basic strategy is for a player to reposition his pieces at the end of his turn so that no matter what move is made by the other player during his turn, the other player will have one or more pieces which can be captured following his turn.

Further objects, features and advantages of the invention will become apparent upon consideration of the following detailed description in conjunction with the drawing, in which.

Figure 1:
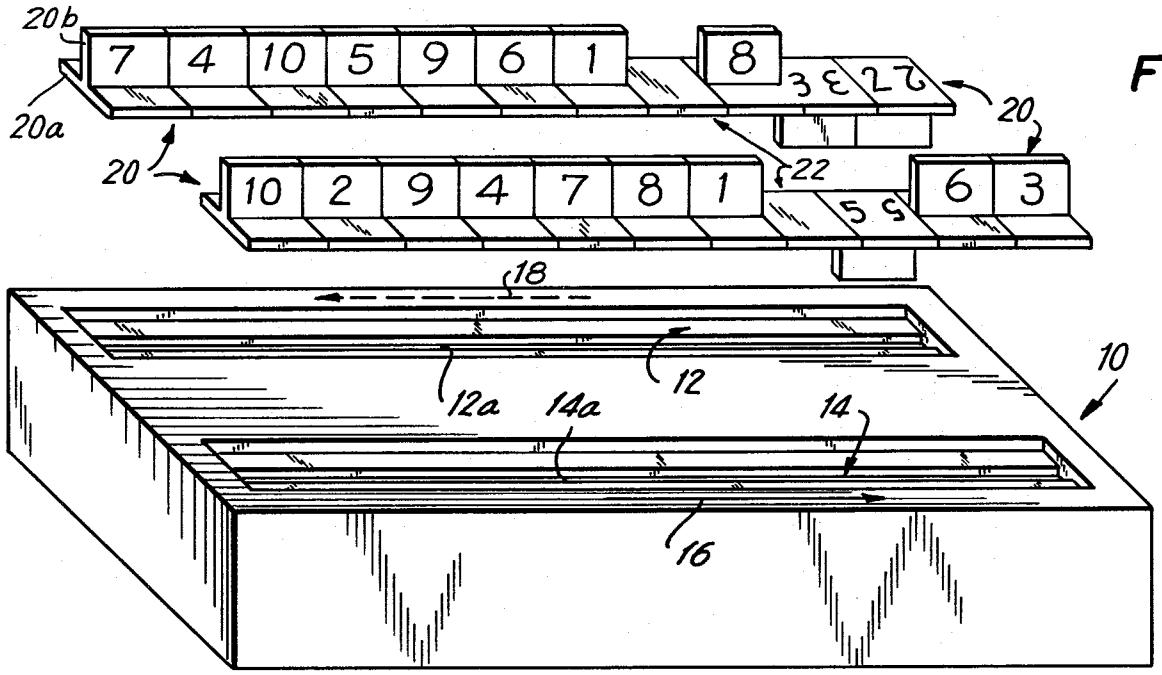
FIG. 1 is a perspective view depicting a game in progress.

Board 10 contains two grooves 12, 14, with each groove having a respective slit **12*a*, 14*a* at the bottom thereof. Each player is provided with a set of ten player pieces 20, each player piece having a base section 20*a* and an upstanding section 20*b*. The ten player pieces in each set are numbered 1 through 10 as shown in FIG. 1, and preferably two different colors are used for the two sets of pieces. The ten pieces of each player are placed in a respective groove 12 or 14. Because the number of each piece is represented on both faces of the upstanding section 20*b*, each player can see the values of all of the pieces at all times. (Captured pieces are turned upside down, as will be described below. The value of each piece is also represented on the bottom of its base section 20*a* so that it can be seen by the players; the value is represented on the bottom of each piece in both possible orientations as shown in FIG. 1** so that each player can see a correctly oriented number.)

Each player is also provided with a marker 22. This marker simply separates the pieces which remain in play (left side of FIG. 1) from the pieces which are out of play (right side of FIG. 1). The ten player pieces and the marker of each player fit within his respective groove on the board, there being a clearance of approximately $\frac{1}{8}$ of an inch in the length of the groove to facilitate removal of player pieces and their re-positioning.

Figure 3:
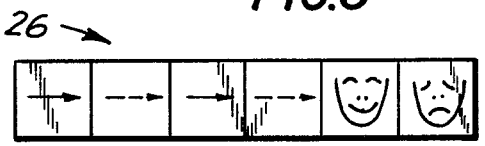
FIG. 3 depicts the six faces of the die which is used in the illustrative embodiment of the invention.
Figure 2:
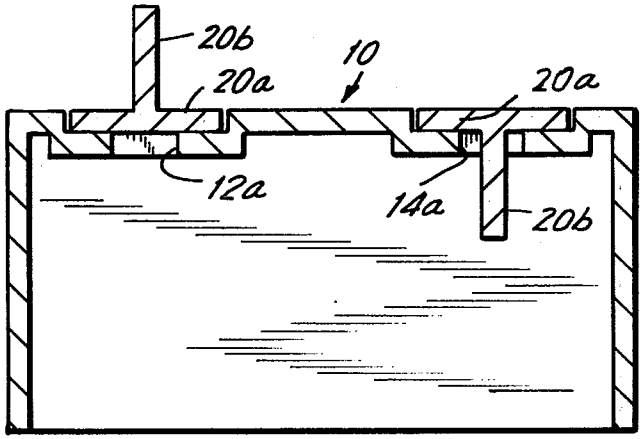
FIG. 2 is a sectional view through the board 10 of FIG. 1.

On the board there are depicted a solid arrow 16 and a dashed arrow 18. These arrows represent "move" directions, as will be described below. FIG. 3 depicts symbolically the six faces of a die 26. Each player rolls the die during his turn and makes a type of move determined by the die face which is rolled. The rules and play of the game are as follows:

CAPTURE RULE

Initially, each piece of one player can capture the three next lower-numbered pieces of the other player. For example, player A's piece of value 8 can capture player B's pieces of values 7, 6 and 5. In addition, a piece of value 1 can capture the other player's pieces of values 10, 9 and 8; a piece of value 2 can capture the other player's pieces of values 1, 10 and 9; and a piece of value 3 can capture the other player's pieces of values 2, 1 and 10.

The capture rule can be expressed as follows: if the numbers in each group (1–10) are arranged clockwise in ascending order, with the lowest and highest numbers being adjacent to each other, then a piece having any value in the clockwise order can capture any piece of the other player whose value is one of those in a predetermined-size sub-group of adjacent numbers in the counter-clockwise direction. (Hereinafter, the term "lower-numbered" piece refers to a piece which can be captured, even if its actual number is higher than that of the capturing piece, in accordance with the capture rule.

For example, in this context, pieces with values of 10, 9 and 8 are "lower-numbered" than a piece with a value of 1.)

It will be noted that initially the predetermined-size sub-group consists of three adjacent numbers. However, as will be described below, as the game progresses the subgroup increases in size. The first time that the sub-group increases in size, each piece can capture the four next lower-numbered pieces of the other player (for example, a piece of value 3 can capture the other player's pieces of values 2, 1, 10 and 9). The next increase in the size of the sub-group is to five pieces, then six, etc.

Solid and Dashed Arrow Moves

The two arrows 16, 18 on the board apply to both players and identify move directions. Markers 22 separate the pieces remaining in play from those which have been taken out of play, and any move involves only those pieces of the player whose turn it is which remain in play.

A solid-arrow move consists of a player removing from his groove one of his pieces which remain in play, moving it in the direction of the solid arrow, and inserting it within his line of pieces which remain in play or at the end of his line of pieces which remain in play. As the moved piece is inserted in the groove, the adjacent pieces are moved in the direction of the dashed arrow so as to reposition the pieces which remain in play without changing the total linear dimension of these pieces.

Consider the following example in which the numerals 1–10 represent one player's pieces, the symbol X represents his marker, and the pieces still in play are to the left of the marker:

| | | | | | | | | | | |
|---|---|---|---|---|---|---|---|---|---|---|
| 2 | 4 | 1 | 10 | 7 | 6 | X | 3 | 5 | 9 | 8 |

For one player, the solid arrow goes from left to right, and the dashed arrow goes from right to left. For the other player, the solid arrow goes from right to left, and the dashed arrow goes from left to right. A solid-arrow move for one player thus consists of moving a piece from left to right, and for the other player of moving a piece from right to left. In the above example, for the player whose solid-arrow move is from left to right, the following are three possible moves which can be taken:

| | | | | | | | | | | |
|---|---|---|---|---|---|---|---|---|---|---|
| 4 | 1 | 10 | 7 | 6 | 2 | X | 3 | 5 | 9 | 8 |
| 2 | 4 | 1 | 7 | 6 | 10 | X | 3 | 5 | 9 | 8 |
| 2 | 1 | 10 | 7 | 4 | 6 | X | 3 | 5 | 9 | 8 |

A dashed-arrow move is made in the same way except that the removed piece of the player is moved in the direction of the dashed arrow before it is inserted between two other pieces or at the end of the player's line of pieces which remain in play. In the same example, the following are three possible position sequences after the same player has taken a dashed-arrow move:

| | | | | | | | | | | |
|---|---|---|---|---|---|---|---|---|---|---|
| 6 | 2 | 4 | 1 | 10 | 7 | X | 3 | 5 | 9 | 8 |
| 2 | 4 | 1 | 6 | 10 | 7 | X | 3 | 5 | 9 | 8 |
| 2 | 4 | 7 | 1 | 10 | 6 | X | 3 | 5 | 9 | 8 |

The Two Parts of Each Turn

The two markers 22 always remain facing each other, and separate the pieces that remain in play from the pieces that have been involved in a capture. At the start of the game, the two markers are both placed at one (either) end of the board, and all ten pieces of each player are initially in play. Whenever a piece of one player captures a facing piece of the other, both pieces are moved to the non-playing side of the markers to indicate that they are both out of play. As the game progresses, the two markers gradually move from one end of the board to the other, and the playing side of the markers gets shorter.

The first part of each player's turn is the "capture" step. The player checks which of his pieces face pieces of the other player which can be captured. The capturing and captured pieces are then moved to the non-playing side of the markers. The captured piece or pieces are turned upside down. This allows the score to be determined easily; each player's score equals the number of his pieces which are right-side up on the nonplaying side of the markers.

The second part of the player's turn consists of rolling the die and making a corresponding move. If the die shows a solid arrow, the player must make a solid-arrow move. If the die shows a dashed arrow, the player must make a dashed-arrow move. If the die shows a face with a smile, the player decides on either a solid-arrow or a dashed-arrow move. If the die shows a face with a frown, the other player decides on either a solid-arrow or dashed-arrow move to be taken by the player who rolled the die.

As shown in FIG. 3, two of the die faces represent solid-arrow moves and two of them represent dashed-arrow moves. The face with a smile represents a "free choice" for the player whose move it is, and the face with a frown represents a "dictated choice" — the other player dictates to the player whose turn it is which type of move he must take.

Play of the Game

The two players place their pieces in their respective grooves, with the markers at one (either) end of the board, as follows. The first player (determined by choosing) inserts one of his pieces at one end of the board. The second player then inserts two of his pieces at the same end. The players then alternate, each placing two pieces at a time on the board, always next to his previously placed pieces, until the last player has only one piece left which he places in his groove. A player is not allowed to place one of his pieces facing a piece of the other player which can be captured (for example, he cannot place his 8 facing the other player's 5), unless all of his remaining pieces can capture the other player's facing piece (i.e., he has no choice but to place one of his pieces facing a piece of the other player which can be captured).

After all of the pieces are thus placed on the board, the player who first placed a piece on the board takes the first turn. During the first four turns (two turns of each player), no captures are permitted. The players simply move their pieces in the directions determined by the die. Only beginning with the third turn of the first player do the players capture pieces at the start of each turn. On this third turn of the first player, he is allowed to capture only a single piece, even though at the start of his turn more than one of the other player's pieces are in positions in which they can be captured. (Otherwise, the first player has too great an advantage.) Starting with the third turn of the second player, both players are permitted to capture as many pieces as possible.

The play continues until the last capture leaves one or no pieces for each player on the playing side of the markers. At such time, the player with the highest score is the winner.

Whenever there are five or fewer pieces of each player remaining on the playing side of the markers, either player, after the capture step but before the die roll step of his turn, may announce that from then on every piece can capture the four next lower-numbered pieces of the other player. (For example, the 3 of either player can capture the other player's 2, 1, 10 and 9.) On a later turn, either player (even the previously, "announcing" player) can announce that thereafter every piece of each player can capture the five next lower-numbered pieces of the other player, then the six next lower-numbered pieces, etc.

Illustrative Examples

Assume that the following is the way the board looks to player B at some point during the early stage of a game, with the solid arrow for him being in a direction from left to right, and the dashed arrow being in a direction from right to left (these two directions for the arrows applying to the remaining discussion, even when A's moves are discussed):

| | | | | | | | | | | | |
|---|---|---|---|---|---|---|---|---|---|---|---|
| A: | 6 | 7 | 1 | 4 | 8 | 9 | 2 | 5 | 10 | 3 | X |

-continued

| | | | | | | | | | | | |
|---|---|---|---|---|---|---|---|---|---|---|---|
| B: | 2 | 7 | 3 | 8 | 4 | 5 | 6 | 1 | 10 | 9 | X |

Assume further that it is B's turn, A having just completed his move. Since B's 3 can capture A's 1, the two pieces are removed from the board and placed on the non-playing side of the markers. After the first stage of B's move, the board looks as follows:

| | | | | | | | | | | | |
|---|---|---|---|---|---|---|---|---|---|---|---|
| A: | 6 | 7 | 4 | 8 | 9 | 2 | 5 | 10 | 3 | X | 1 |
| B: | 2 | 7 | 8 | 4 | 5 | 6 | 1 | 10 | 9 | X | 3 |

A's 1 should be turned upside down in A's groove, to facilitate a rapid determination by both players of their scores as the game progresses.

Player B must now make his move, the second part of his turn. None of his pieces is in danger of being captured and thus he can concentrate on an offensive move. Assume that B's roll of the die calls for a dashed-arrow move, or that he rolled a "free choice" and selects a dashed-arrow move. One such move by B is to remove his 8 from his line of pieces remaining in play, and to move it to the left, to the end of his line of pieces (to the left of his 2). In so doing, his 7 and 8 are moved to the right. After B makes his move, the board appears as follows:

| | | | | | | | | | | | |
|---|---|---|---|---|---|---|---|---|---|---|---|
| A: | 6 | 7 | 4 | 8 | 9 | 2 | 5 | 10 | 3 | X | 1 |
| B: | 8 | 2 | 7 | 4 | 5 | 6 | 1 | 10 | 9 | X | 3 |

B's 7 is now attacking A's 4, and B's 8 is now attacking A's 6. But more important than the two attacks (which A can parry during his turn) is the fact that A's 7 is adjacent to his 6 which is being attacked. If A makes a dashed-arrow move, he can place one of his pieces to the left of his 6, and shift his 6 to the right thus avoiding the attack by B's 8. But suppose that A is required to make a solid-arrow move (because his die roll is one of the two solid arrows, or because he rolls a "frown" and A dictates that he make a solid-arrow move). In this case, the only way that A can protect his 6 is to remove it and move it to the right, for example, by placing it between his 9 and 2. But when he does this, his 7, 4, 8 and 9 will all move to the left, and his 7 will be in a position in which it can be captured by B's 8 at the start of B's next turn. Thus B's move is a good offensive move because there is a 50—50 chance that he will capture either A's 6 or A's 7.

Suppose that the die roll indeed requires A to make a solid-arrow move. A must lose his 6 or his 7, and suppose that he decides to move his 6 (thus giving up his 7) and to insert it between his 9 and 2. In such a case, after he makes the move, the board appears as follows:

| | | | | | | | | | | | |
|---|---|---|---|---|---|---|---|---|---|---|---|
| A: | 7 | 4 | 8 | 9 | 6 | 2 | 5 | 10 | 3 | X | 1 |
| B: | 8 | 2 | 7 | 4 | 5 | 6 | 1 | 10 | 9 | X | 3 |

It will be recalled that following B's last move, his 7 was attacking A's 4, at the same time that his 8 was attacking A's 6. Although A must now lose a piece, he has at least saved his 4.

At the start of B's next turn, his 8 captures A's 7, and he moves them both to the non-playing side of the markers. After the capture step of his move, the board looks as follows:

| | | | | | | | | | | | |
|---|---|---|---|---|---|---|---|---|---|---|---|
| A: | 4 | 8 | 9 | 6 | 2 | 5 | 10 | 3 | X | 1 | 7 |
| B: | 2 | 7 | 4 | 5 | 6 | 1 | 10 | 9 | X | 3 | 8 |

It should be noted that B's 2, 7 and 5 are under attack by A's 4, 8 and 6 respectively. A's last move was a wise one because it set up the board such that B may now lose a piece. If B is permitted to make a solid-arrow move, he can remove his 2 and insert it between his 5 and 6, for example, and none of his pieces will be in a position to be captured at the start of A's next turn. But if B is required to make a dashed-arrow move, he must lose a piece. If B tries to protect his 5 and his 2 by moving the 5 to the left of the 2, he will save both of these pieces because his 5 will face A's 4 and therefore be safe, and his 2 will face A's 8 and therefore be safe. However, his 4 will now face A's 6 and his 7 will face A's 9, and he will lose both his 4 and his 7. The only way that B can minimize his loss is to move his 7 to the left of his 2. (The switching of any two adjacent pieces is always possible, since the exchange of any two adjacent pieces is both a solid-arrow and a dashed-arrow move.) By switching his 7 and 2, the only piece which B will lose will be his 5.

As mentioned above, when each player has five or fewer pieces remaining in play, either player — after the capture step of his turn — can announce that thereafter every piece on the board which remains in play can capture the four next lower-numbered pieces of the other player. Consider the following example, in which it is assumed that it is B's turn:

| | | | | | | | | | | | |
|---|---|---|---|---|---|---|---|---|---|---|---|
| A: | 4 | 7 | 5 | 6 | 10 | X | 9 | 3 | 2 | 8 | 1 |
| B: | 10 | 6 | 1 | 5 | 9 | X | 2 | 4 | 3 | 7 | 8 |

B can capture none of A's pieces. Before he rolls the die, he must decide whether to announce that from then on every piece can capture the four next lower-numbered pieces of the other player. The first player who can possible gain a benefit from this increased capture capability is A, because after B rolls the die and makes his move, it is A whose turn it will be to capture pieces. Thus before B makes his "announcement," it is wise for him to make certain that if he does increase the capture capability of both players, he can at least make a move which will place none of his pieces in a position in which it can be captured. B indeed has "safe" solid-arrow and dashed-arrow moves. If he moves his 10 to the right of his 9, none of his pieces will be attacked even though each of A's pieces will be able to capture four of B's next lower-numbered pieces. Similarly, if B moves his 9 to the left of his 10, all of his pieces will be safe.

The fact that B has a "safe" move no matter what his roll of the die does not necessarily mean that he should expand the capture rule. Often, the decision to expand the capture capability is based on the next immediate turn, a player expanding the capture capability if he sees a possibility of capturing a piece following the other player's next move. But unless an immediate gain is foreseen, it may not pay for a player to make the "announcement".

In the present case, it will be noted that with each piece being capable of capturing only the three next lower-numbered pieces of the other player, B's 10 can capture only A's 7, B's 6 can capture A's 4 and 5, B's 1 can capture A's 10, B's 5 can capture A's 4, and B's 9 can capture A's 7 and 6. B thus has seven capture possibilities. A, on the other hand, has only five capture possibilities (his 4 can capture B's 1, his 7 can capture B's 6 and 5, his 5 can capture no pieces, his 6 can capture B's 5, and his 10 can capture B's 9).

On the other hand, suppose that B announces that from then on every piece can capture the four next lower-numbered pieces of the other player. In such a case, not only will B have his previous seven capture possibilities, but now his 10 will be able to attack A's 6, his 1 will be able to attack A's 7, and his 9 will be able to attack A's 5. Thus he will have three additional capture possibilities. But A will also increase his capture possibilities by three (his 4 will now be able to attack B's 10, his 5 will now be able to attack B's 1, and his 10 will now be able to attack B's 6). Thus by making an "announcement," B's advantage will change from 7:5 to 10:8. This is no gain, since the change is in a direction which tends to equalize the capture possibilities. Of course, if as a result of an "announcement" B would acquire more capture possibilities than A, it would be to his advantage to increase the capture capability of all pieces.

As a last example, consider the following situation, in which it is B's turn:

| | | | | | | | | | | | |
|---|---|---|---|---|---|---|---|---|---|---|---|
| A: | 5 | 8 | 7 | X | 10 | 9 | 6 | 2 | 3 | 4 | 1 |
| B: | 3 | 2 | 1 | X | 7 | 6 | 9 | 4 | 10 | 5 | 8 |

It should be noted that A is winning the game thus far, A having captured four pieces and B having captured only three. It is further assumed that neither player has yet increased the capture capability from three to four pieces. B realizes that sooner or later A will do so, for then A's 5 will be able to capture all three of B's pieces, B's 1 (as well as his 3 and 2) then being "capturable" by A's 5. Eventually, B will have to lose a piece to A's 5, and the score will be 5-3 in A's favor.

However, by increasing the capture capability before he rolls the die, B can actually insure that the game will be a tie. B should first announce that from then on every piece can capture the four next lower-numbered pieces of the other player. He should then roll the die and, no matter what the roll, simply switch his 1 and 2. (As mentioned above, switching any two adjacent pieces is both a solid-arrow and a dashed-arrow move.) Following his move, the pieces which remain in play will appear as follows:

| | | | |
|---|---|---|---|
| A: | 5 | 8 | 7 |
| B: | 3 | 1 | 2 |

At the start of his next turn, A will remove his 5 and B's 3 from play, and the score will then be 5 to 3. A's 8 faces B's 1 and cannot capture it, and his 7 faces B's 2 and cannot capture it. No matter what the roll of the die, A's "move" must be to switch his 7 and 8 since he only has two pieces remaining in play. At the start of B's next turn, the pieces remaining in play will appear as follows:

| | | |
|---|---|---|
| A: | 7 | 8 |
| B: | 1 | 2 |

Because B during his previous turn announced that each piece could capture the four next lower-numbered pieces of the other player, his 1 can now capture A's 7 and his 2 can now capture A's 8. Consequently, at the start of B's turn, he can capture both of A's two remaining pieces, and the game is a 5—5 tie.

It should be noted that the game terminates when the last capture leaves one or no pieces for each player on the board. In this particular example, the game obviously comes to an end because no pieces remain in play following the last two captures.

Although the invention has been described with reference to a particular embodiment, it is to be understood that this embodiment is merely illustrative of the application of the principles of the invention. For example, instead of marking the pieces with numbers, alphabet letters could be used. Similarly, any set of ordered symbols could be utilized. (Although not as advantageous, every piece could actually depict on it the symbols of the other player's pieces which it can capture.)

Instead of using a die, some other type of chance-controlled mechanism can be used. And instead of providing pieces which are physically moved, the entire game can be implemented electronically with digit displays. In such a case, the players might operate a keyboard to indicate the moves which they are making, and the numerals would shift from display to display, without the physical displays themselves being moved. (In such a case, the "pieces" are the numerals themselves which are moved from position to position.)

It is also possible to change the rules slightly without deviating from the basic concept of the invention. For example, it might be decided that the game terminates only when no pieces remain on the board. In such a case, when each player has only one piece remaining in play, there would be no "moves" and one of the players would simply continue to increase the capture capability during each of his turns until eventually his remaining piece could capture the other player's remaining piece. Similarly, it is possible to allow captures starting with the first player's first turn, although this is not desirable because it gives too great an advantage to the second player; following the first player's first move, there will be several pieces which can usually be captured by the second player at the start of his turn.

It is also possible to provide "moves" (by changing some of the die faces) in which a player takes both a solid-arrow move and a dashed-arrow move during the second step of his turn, with either sub-move being taken before the other, the solid-arrow move being required before the dashed-arrow move, or the dashed-arrow move being required before the solid-arrow move, depending upon the roll of the die. Rather than to use a six-faced die, the chance-controlled mechanism might have nine possibilities, the six shown in the illustrative embodiment of the invention and three more of the type just described, each involving two sub-moves. Thus it is to be understood that numerous modifications may be made in the illustrative embodiment of the invention and other arrangements may be devised without departing from the spirit and scope of the invention.

What I claimed is:

1. A method for playing a board game, said board game having a board; two sets of player pieces, each of the pieces of each player containing a marking thereon indicative of pieces of the other player which it can capture and pieces of the other player by which it can be captured, said board having two parallel means for linearly positioning respective sets of said player pieces facing each other and facilitating the changing of the relative positions of the player pieces in each set; and means controlled by chance for representing a type of move to be taken by each player in his turn during which such player removes one of his player pieces which remain in play and re-positions it elsewhere in the line of his player pieces which remain in play;

said method comprising the steps of:

(a) the players taking alternate turns, (b) each player, at the start of his turn, removing from play both those of his pieces which can capture respective facing pieces of the other player, and the captured pieces, and (c) each player, at the end of his turn, making a move of the type represented by said chance-controlled means.

2. A method for playing a board game in accordance with claim 1 further including the step of:

(d) terminating the game when the number of player pieces remaining in play is less than a predetermined number.

3. A method for playing a board game in accordance with claim 1 wherein each of said sets of player pieces has between seven and fourteen pieces, and the markings on said player pieces are numerical values.

4. A method for playing a board game in accordance with claim 3 wherein at the start of the game each player piece, in accordance with its numerical value, can capture a predetermined number of the other player's pieces in accordance with their numerical values, and as the game progresses each player piece, in accordance with its numerical value, can capture a greater number of the other player's pieces in accordance with their numerical values.

5. A method for playing a board game in accordance with claim 4 wherein, after the number of player pieces remaining in play is less than a predetermined number, each player during his turn can announce that thereafter every player piece can capture one more player piece of the other player.

6. A method for playing a board game in accordance with claim 4 further including the step, prior to steps (a)-(c), of the players taking alternate turns placing their pieces on the board from one end thereof to the other.

7. A method for playing a board game in accordance with claim 6 wherein in said last-mentioned step each player is allowed to place on the board only a piece which is incapable of capturing a facing piece of the other player, unless all of the player's pieces remaining to be placed on the board can capture a facing piece of the other player.

8. A method for playing a board game in accordance with claim 7 wherein said last-mentioned step the first player places a single one of his player pieces on the board, and the players then alternate each placing two of his remaining player pieces on the board until all of the player pieces have been placed on the board.

9. A method for playing a board game in accordance with claim 6 wherein said chance-controlled means includes the representation of at least a first move type in which a selected player piece must be moved in a first direction and a second move type in which a selected player piece must be moved in a second, opposite direction.

10. A method for playing a board game in accordance with claim 9 wherein said chance-controlled means further includes the representation of a "free choice" for a player allowing him to choose between said first and second move types, and the representation of a "dictated choice" for a player allowing the other player to choose between said first and second move types to be taken by the player whose turn is in progress.

11. A method for playing a board game in accordance with claim 1 wherein the markings on said player pieces are numerical values, at the start of the game each player piece, in accordance with its numerical value, can capture a predetermined number of the other player's pieces in accordance with their numerical values, and as the game progresses each player piece, in accordance with its numerical value, can capture a greater number of the other player's pieces in accordance with their numerical values.

12. A method for playing a board game in accordance with claim 11 wherein, after the number of player pieces remaining in play is less than a predetermined number, each player during his turn can announce that thereafter every player piece can capture one more player piece of the other player.

13. A method for playing a board game in accordance with claim 11 wherein the markings on each of said sets of player pieces comprise an identical group of ordered numbers and each piece of each player can capture a facing piece of the other player in accordance with the following rule: if the numbers in the group are ordered clockwise in ascending order, with the lowest and highest numbers being adjacent to each other, then a piece having any value in the clockwise order can capture any piece of the other player whose value is one of those in a predetermined-size sub-group of adjacent numbers in the counter-clockwise direction.

14. A method for playing a board game in accordance with claim 1 wherein said chance-controlled means includes the representation of at least a first move type in which a player moves one of his pieces in a first direction and a second move type in which a player moves one of his pieces in a second, opposite direction.

15. A method for playing a board game in accordance with claim 14 wherein the markings on each of said sets of player pieces comprise an identical group of ordered symbols and each piece of each player can capture a facing piece of the other player in accordance with the following rule: if the symbols in the group are ordered clockwise, with the first and last symbols being adjacent to each other, then a piece having any symbol in the clockwise order can capture any piece of the other player whose symbol is one of those in a predetermined-size sub-group of adjacent symbols in the counter-clockwise direction.

16. A method for playing a board game in accordance with claim 15 wherein during a selected number of initial player turns step (b) is omitted.

17. A method for playing a board game in accordance with claim 15 wherein at the start of the game each player piece, in accordance with its symbol, can capture a predetermined number of the other player's pieces in accordance with their symbols, and as the game progresses each player piece, in accordance with its symbol, can capture a greater number of the other player's pieces in accordance with their symbols.

18. A method for playing a board game in accordance with claim 17 wherein, after the number of player pieces remaining in play is less than a predetermined number, each player during his turn can announce that thereafter every player piece can capture one more player piece of the other player.

19. A method for playing a board game in accordance with claim 1 further including the step, prior to steps (a)-(c), of the players taking alternate turns placing their pieces on the board from one end thereof to the other.

20. A method for playing a board game in accordance with claim 19 wherein in said last-mentioned step each player is allowed to place on the board only a piece which is incapable of capturing a facing piece of the other player, unless all of the player's pieces remaining to be placed on the board can capture a facing piece of the other player.

21. A method for playing a board game in accordance with claim 20 wherein said last-mentioned step the first player places a single one of his player pieces on the board, and the players then alternate each placing two of his remaining player pieces on the board until all of the player pieces have been placed on the board.

22. A method for playing a board game in accordance with claim 1 wherein at the start of the game each player piece, in accordance with its symbol, can capture a predetermined number of the other player's pieces in accordance with their symbols, and as the game progresses each player piece, in accordance with its symbol, can capture a greater number of the other player's pieces in accordance with their symbols.

23. A method for playing a board game in accordance with claim 22 wherein, after the number of player pieces remaining in play is less than a predetermined number, each player during his turn can announce that thereafter every player piece can capture one more player piece of the other player.

24. A method for playing a board game in accordance with claim 23 further including the step, prior to steps (a)-(c), of the players taking alternate turns placing their pieces on the board from one end thereof to the other.

25. A method for playing a board game in accordance with claim 24 wherein in said last-mentioned step each player is allowed to place on the board only a piece which is incapable of capturing a facing piece of the other player, unless all of the player's pieces remaining to be placed on the board can capture a facing piece of the other player.

26. A method for playing a board game in accordance with claim 25 wherein in said last-mentioned step the first player places a single one of his player pieces on the board, and the players then alternate each placing two of his remaining player pieces on the board until all of the player pieces have been placed on the board.

27. A method for playing a board game in accordance with claim 1 wherein said chance-controlling means includes the representation of at least a first move type in which a selected player piece must be moved in a first direction, the representation of a second move type in which a selected player piece must be moved in a second, opposite direction, the representation of a "free choice" for a player allowing him to choose between said first and second move types, and the representation of a "dictated choice" for a player allowing the other player to choose between said first and second move types to be taken by the player whose turn is in progress.

28. A method for playing a board game in accordance with claim 27 wherein at the start of the game each player piece, in accordance with its marking, can capture a predetermined number of the other player's pieces in accordance with their markings, and as the game progresses each player piece, in accordance with its marking, can capture a greater number of the other player's pieces in accordance with their markings.

29. A method for playing a board game in accordance with claim 28 wherein, after the number of player pieces remaining in play is less than a predetermined number, each player during his turn can announce that thereafter every player piece can capture one more player piece of the other player.

30. A method for playing a board game in accordance with claim 29 wherein the markings on each of said sets of player pieces comprise an identical group of ordered symbols and each piece of each player can capture a facing piece of the other player in accordance with the following rule: if the symbols in the group are ordered clockwise, with the first and last symbols being adjacent to each other, then a piece having any symbol in the clockwise order can capture any piece of the other player whose symbol is one of those in a predetermined-size sub-group of adjacent symbols in the counter-clockwise direction.

31. A method for playing a board game in accordance with claim 1 wherein said chance-controlled means includes the representation of a "free choice" for a player allowing him to choose between first and second move types, and the representation of a "dictated choice" for a player allowing the other player to choose between said first and second move types to be taken by the player whose turn is in progress.

32. A method for playing a board game in accordance with claim 1 wherein the markings on each of said sets of player pieces comprise an identical group of ordered symbols and each piece of each player can capture a facing piece of the other player in accordance with the following rule: if the symbols in the group are ordered clockwise, with the first and last symbols being adjacent to each other, then a piece having any symbol in the clockwise order can capture any piece of the other player whose symbol is one of those in a predetermined-size sub-group of adjacent symbols in the counter-clockwise direction.

33. A method for playing a board game in accordance with claim 32 wherein during a selected number of initial player turns step (b) is omitted.

34. A method for playing a board game in accordance with claim 1 wherein during a selected number of initial player turns step (b) is omitted.

35. A method for playing a board game in accordance with claim 1 wherein each of said sets of player pieces has between seven and fourteen pieces.

36. A method for playing a board game in accordance with claim 1 wherein the markings on said player pieces are numerical values.

* * * * *